United States Patent [19]

Martensson, IV

[11] Patent Number: 4,641,805

[45] Date of Patent: Feb. 10, 1987

[54] AWNING SUPPORT SYSTEM

[75] Inventor: Olof Martensson, IV, Annapolis, Md.

[73] Assignee: Awnings Unlimited, Inc., Annapolis, Md.

[21] Appl. No.: 790,438

[22] Filed: Oct. 23, 1985

[51] Int. Cl.[4] ..... E04F 10/02

[52] U.S. Cl. ..... 248/273; 248/223.4

[58] Field of Search ..... 248/273, 73, 311.3, 248/310, 312.1, 255, 48.1, 48.2, 223.4, 251, 224.2, 253, 267, 220.2, 224.1; 160/323 B, 70, 66

[56] References Cited

U.S. PATENT DOCUMENTS

| | | | |
|---|---|---|---|
| 2,515,523 | 7/1950 | Mancino | 248/312.1 |
| 3,733,043 | 5/1973 | Binns | 248/224.2 |
| 3,829,050 | 8/1974 | Brautaset | 248/223.4 |
| 3,851,848 | 12/1974 | Wale | 248/273 |
| 4,036,369 | 7/1977 | Ersenberg | 248/48.2 |

FOREIGN PATENT DOCUMENTS

| | | | |
|---|---|---|---|
| 379829 | 8/1964 | Switzerland | 248/311.3 |
| 21318 | of 1912 | United Kingdom | 248/48.2 |
| 58-6346 | 1/1947 | United Kingdom | 248/48.2 |
| 967284 | 8/1964 | United Kingdom | 248/48.2 |
| 1008991 | 11/1965 | United Kingdom | 248/223.4 |

*Primary Examiner*—Reinaldo P. Machado
*Assistant Examiner*—Alvin Chin-Shue
*Attorney, Agent, or Firm*—Brady, O'Boyle & Gates

[57] ABSTRACT

A lateral arm awning support system includes a mounting bracket assembly comprised of first and second interfitting and interlocking extruded bracket components one of which embraces and supports a main support tube of the lateral arm awning. The other mounting bracket component includes an arcuate wall which rigidifies the mounting bracket assembly in two orthogonal planes, and further includes a top flat wall which is perpendicular to a flat vertical wall of the first mounting bracket component.

11 Claims, 7 Drawing Figures

FIG. 1
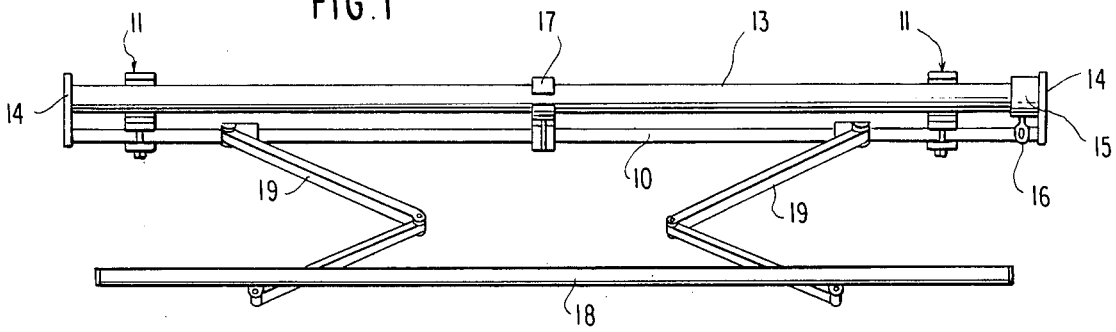
FIG. 2
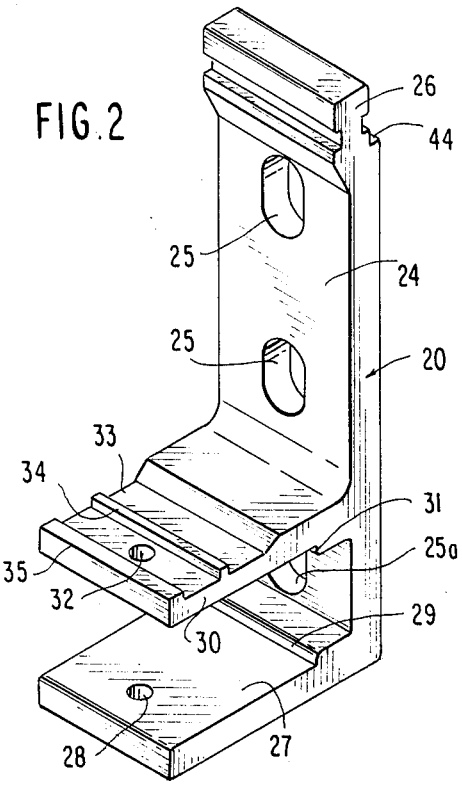
FIG. 3
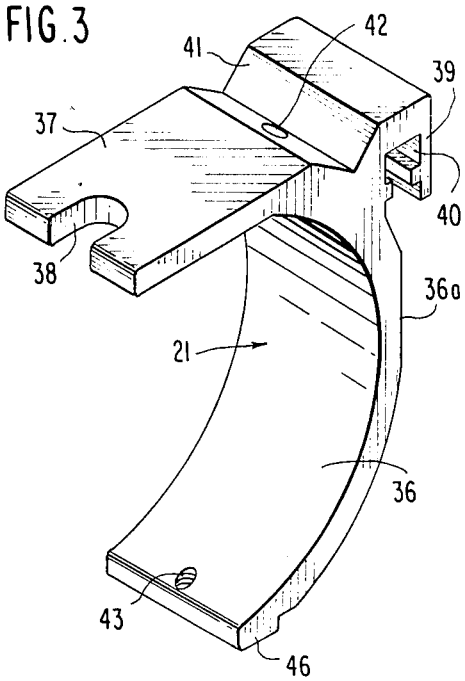
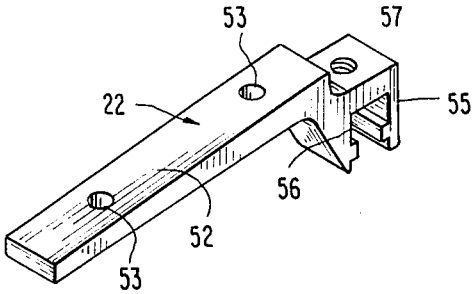
FIG. 4

AWNING SUPPORT SYSTEM

BACKGROUND OF THE INVENTION

This invention relates to support systems for awnings and more particularly to an improved support system for lateral arm awnings also known as European-type awnings.

Lateral arm awnings include a main support tube held by brackets which can be attached to walls or to an eave soffit in appropriate situations. Wall-mounted lateral arm awnings may include a protective hood above the awning fabric roller tube and front bar when the latter is retracted.

Traditionally, the main support tube of the lateral arm awning is held and supported in cast aluminum brackets which are expensive to manufacture, bulky, and subject to the known disadvantages of metal castings. One aspect of the present invention is the complete elimination of the use of castings for the bracket components of the awning support system. Instead, the bracket components employed are aluminum extrusions, which are less bulky, stronger and more dimensionally precise.

An object of the present invention is to provide a mounting bracket arrangement for lateral arm awnings which possesses greater universality than known prior art bracket arrangements. For example, in accordance with the present invention, a minimum number of extruded aluminum bracket components is provided to enable a lateral arm awning to be installed with facility on either a vertical wall, with or without a fabric roll protecting hood, or on the bottom surface of an eave soffit. In each case, the bracket mounting is secure and stable and provides firm support for the main support tube of the lateral arm awning.

Prior art mounting bracket arrangements for awnings utilizing three separable bracket components are known. However, the construction and coactive relationship of these components is such that the use of the bracket arrangement is rather limited and lacks the degree of versatility of use which is desirable in the installation of lateral arm awnings in the various environments which are encountered in practice. The present invention improves significantly on the prior art through the provision of a mounting bracket arrangement which involves a new combination of bracket components having greater versatility of usage in carrying out the several different types of installations of lateral awnings which must be dealt with in practice. In other words, in accordance with the present invention, three bracket components formed as aluminum extrusions can be employed in several different ways to render possible the installation of a lateral arm awning in any of the environments commonly found in the field. This degree of versatility has not existed in the prior art and therefore constitutes a very substantial feature of the present invention.

Another object of the invention is to provide an extruded mounting bracket component for lateral arm awnings which materially strengthens the awning mounting while forming an accommodation or housing for the fabric roll and roller tube of the awning. The new bracket component which is arcuate in cross section is very rigid in two orthogonal planes and facilitates anchoring the top of the mounting bracket assembly to a wall member or soffit by means of a diagonal tension bolt or screw.

Other features and advantages of the invention will become apparent to those skilled in the art during the course of the following detailed description.

BRIEF DESCRIPTION OF THE DRAWINGS

FIG. 1 is a front elevational view of a lateral arm awning having a support system in accordance with the present invention.

FIG. 2 is a perspective view of one mounting bracket component in the support system.

FIG. 3 is a perspective view of another mounting bracket component.

FIG. 4 is a perspective view of a third mounting bracket component in the support system.

DETAILED DESCRIPTION

Figure 5:
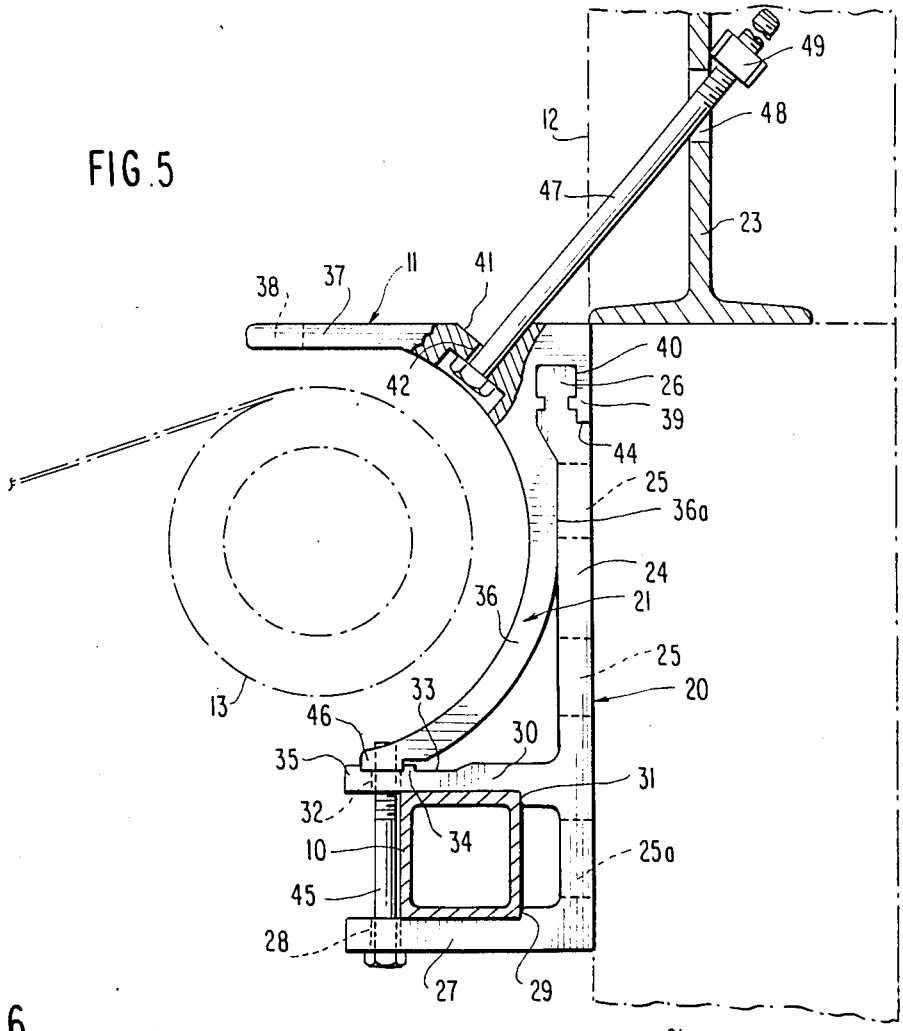
FIG. 5 is a vertical section taken through the support system for a wall-mounted lateral arm awning according to the invention.

Referring to the drawings in detail wherein like numerals designate like parts, attention is directed to FIG. 1 showing a lateral arm awning having an improved support system in accordance with the present invention. A main support tube 10 having a rectangular cross section is held and supported in a pair of mounting bracket assemblies 11 constructed in accordance with the invention. In the illustration of FIG. 1, the awning and its support system are mounted on a vertical wall 12 as depicted in FIG. 5. The wall may be a masonry wall or a wooden wall, as will be further discussed. The lateral arm awning comprises an awning fabric roll 13 having a roller tube or core which is supported at its opposite ends by a pair of supports 14 fixed to the ends of the main support tube 10. One support 14 is equipped with a conventional gear drive 15 for the awning roll 13 having an operating link 16 to be operated by a hand crank, not shown. At its longitudinal center, the elongated roll 13 is engaged and stabilized by a center support 17 fixed to the main support tube 10 in accordance with conventional practice. When the particular awning is longer than the one illustrated in FIG. 1, a greater number of the bracket assemblies 11 is utilized. Two of the bracket assemblies 11 are required for a ten foot awning, three bracket assemblies for a thirteen foot awning, four for an eighteen foot awning, and one additional bracket assembly 11 for each five feet of additional awning width in excess of eighteen feet. In a three bracket support system for a thirteen foot awning, the center bracket assembly 11 can include an insert for engaging and stabilizing the awning roll 13 at its center.

The lateral awning includes a front bar 18 parallel to the main support tube 10 and connected therewith by conventional folding arms 19. The folding arms 19 are biased by conventional spring means, not shown, toward unfolded positions moving the front bar 18 away from the main support tube 10. As a result of this biasing, the awning fabric will be taut in all adjusted positions of the awning under influence of the driving link 16 and gear drive 15.

Figure 6:
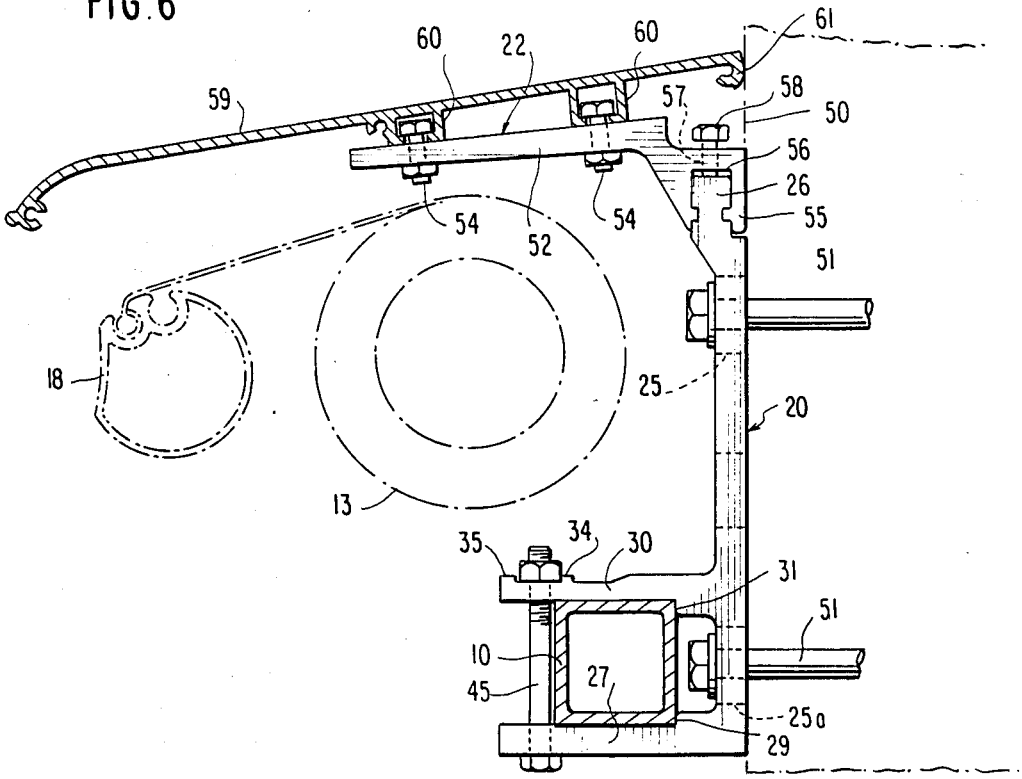
FIG. 6 is a similar view of a support system for a wall-mounted awning including a hood for the fabric roller tube and associated parts.
Figure 7:
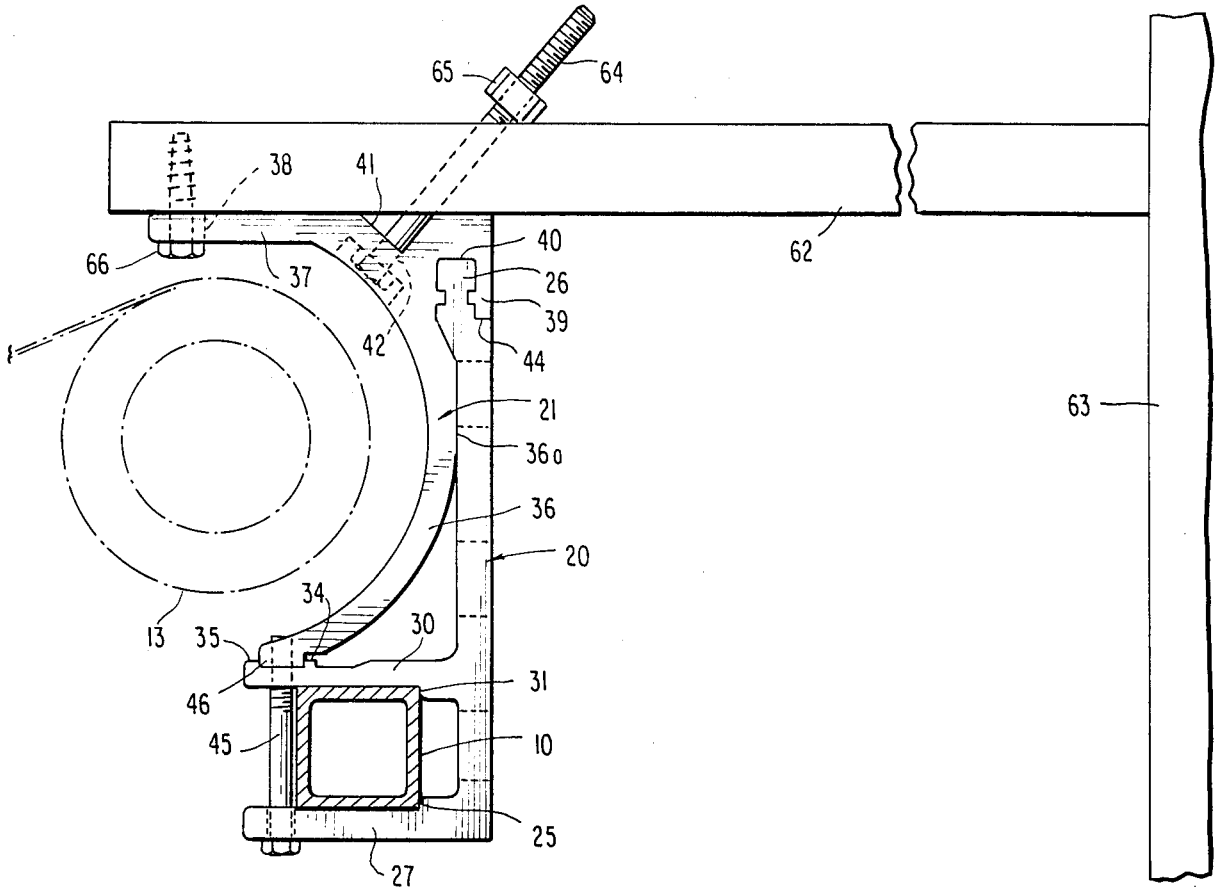
FIG. 7 is a similar view of a support system for a lateral arm awning installed on an eave soffit according to the present invention.

The improved awning support system forming the subject matter of this invention is depicted in its assembled state for three different types of awning installations in FIGS. 5, 6 and 7. Three mounting bracket components employed in the diversified support system are designated by the numerals 20, 21 and 22 in FIGS. 2, 3 and 4.

Referring to FIG. 5 in which the lateral arm awning is mounted on the wall 12 having an internal I-beam 23, the support system is constructed as follows. The two mounting bracket components 20 and 21 which are both aluminum extrusions are interengaged with each other and the bracket component 20 is supportively engaged with the main support tube 10. More particularly, the extruded component 20 includes a flat web 24 which lies against the adjacent vertical face of the wall 12. The flat web 24 has two vertically spaced vertically elongated apertures 25 formed therethrough for a purpose to be described. At its top, the web 24 carries a T-shaped head 26 which is forwardly offset somewhat from the rear face of the web 24 which abuts the wall 12. At its bottom, the bracket component 20 carries a forwardly extending horizontal plate extension 27 having an aperture 28 and a rising shoulder 29 near the rear of the plate extension 27. The bracket component 20 carries a second forwardly projecting plate extension 30 spaced above and parallel to the plate extension 27. The bottom face of plate extension 30 facing the plate extension 27 is flat except for the provision of a shoulder 31 in vertical alignment with the shoulder 29. The plate extension 30 has an aperture 32 in coaxial alignment with the aperture 28 of plate extension 27. On its top face, the plate extension 30 has a depressed surface 33 provided with a rising transverse rib 34 parallel to the shoulders 29 and 31. At its forward end, the plate extension 30 includes a rising lip 35 parallel to the rib 34.

The bracket component 21 includes an arcuate side wall 36 which imparts rigidity to the mounting bracket assembly 11 in two orthogonal planes. At its top, the arcuate wall 36 is joined with a flat horizontal top wall 37 having a forward end slot 38, for a purpose to be described. Also joined with the top of the arcuate wall 36 is a downwardly open yoke extension 39 having a horizontal transverse T-slot or passageway 40 formed therethrough adapted to slidably and adjustably receive the T-head 26 of bracket component 20. A rear flat surface 36*a* perpendicular to the top wall 37 is formed on the bracket component 21.

Between the yoke 39 and top wall 37, the component 21 has a V-groove 41, one surface of which is provided with an inclined aperture 42 extending entirely through the extruded component 21 as shown in FIG. 5. The axis of the inclined aperture 42 is preferably at 45° to the vertical and horizontal, as shown in FIG. 5. At its lower end, the arcuate wall 36 is provided with a center screw-threaded aperture 43.

Referring to FIG. 5, the extruded bracket components 20 and 21 are slidably interengaged through their respective T-head 26 and T-slot 40. The lower edge of the yoke extension 39 contacts a shoulder 44 at the base of T-head 26. The main support tube 10 is received between the two plate extensions 27 and 30 and engages the two shoulders 29 and 31 which locate the tube 10 relative to the face of the wall 12. A screw 45 is placed through the apertures 28 and 32 and is received in the threaded aperture 43 of component 21. The screw 45 retains the main support tube 10 between the plate extensions 27 and 30. A pad 46 on the lower end of arcuate wall 36 engages between the rib 34 and lip 35. The two bracket components 20 and 21 are thus securely interengaged and held against relative movement and, in effect, form a unified mounting bracket for the main support tube 10.

A suspension bolt 47 for the mounting bracket is received through the inclined axis aperture 42 and through an opening 48 of the I-beam 23. A nut 49 is adjusted on the suspension bolt 47 to regulate the height of the mounting bracket assembly 11 on the wall 12. The elongated apertures 25 are not utilized in the wall mounted installation shown in FIG. 5, and the flat face of the bracket component 20 merely abuts the opposing surface of the wall 12 and the inclined bolt 47 carries the load. The arcuate wall 36, in addition to rigidifying the bracket assembly 11, accommodates the awning fabric roll 13 so that the same can be positioned close to the wall 12.

FIG. 6 of the drawings shows a substantially conventional support system for a lateral arm awning on a wall 50. The previously-described bracket component 20 is utilized without the component 21 and the suspension bolt 47. Instead of this bolt, a pair of horizontal anchor bolts 51 are engaged through the uppermost elongated aperture 25 and through a like aperture 25*a* of bracket component 20. The anchor bolts 51 penetrate the wall 50 and may carry conventional expander means, not shown. In the case of wooden walls, the bolts 51 are eliminated and wood screws are employed. In FIG. 5, the suspension bolt 47 may be a wood screw where the wall involved has wooden framing.

In FIG. 6, in lieu of the arcuate bracket component 21, the bracket component 22 shown in FIG. 4 is employed. This constitutes a hood support bracket element. The hood support bracket element 22 includes an elongated slightly inclined cantilever arm 52 having spaced apertures 53 for bolt and nut sets 54. The rear end of the hood support element 22 carries a somewhat depressed downwardly open yoke 55 having a T-slot or passage 56 formed therethrough for interengagement with the T-head 26 of bracket component 20. The top wall of yoke 55 has a threaded aperture 57 formed therethrough for the reception of a set screw 58 which bears on the T-head 26 and securely locks the hood support element or component element 22 to the bracket component 20. The element 22 is an aluminum extrusion.

An extruded aluminum hood 59 is placed above the support element 22 and extends over and protects the awning fabric roll 13 and the front bar 18 of the lateral arm awning when the front bar is retracted. On its lower side, the hood 59 carries channels 60 which receive the heads of the bolts 54 loosely until the hood is properly adjusted, following which the nuts on the bolts 54 are tightened to lock the hood 59 to its support element 22, as shown in FIG. 6. A rear end knuckle 61 of the hood preferably contacts the front face of the wall 50.

FIG. 7 of the drawings illustrates the mounting of the awning and its support system on a horizontal eave soffit 62 projecting forwardly from a wall 63. Again, the bracket components 20 and 21 are employed together in the identical relationship shown in FIG. 5 and described previously. An inclined bolt 64 of appropriate length, similar to the bolt 47, and carrying a nut 65 is employed to anchor the mounting bracket assembly to the bottom face of the soffit 62. The horizontal top wall 37 of arcuate bracket component 21 lies flat against the bottom surface of the soffit 62 and is anchored thereto by a screw 66 received through the slot 38 of the top wall 37. This screw in conjunction with the inclined bolt 64 forms a very secure attachment of the mounting bracket assembly to the bottom of the soffit 62 with the arcuate wall 36 in spaced concentric relationship to the awning fabric roll 13.

The versatility of the awning support system embodied in the multi-component extruded aluminum mounting bracket assemblies can now be appreciated. The assemblies 11 shown in FIGS. 1 and 5 are comprised of the components 20 and 21 suspended on a wall surface by means of the suspension bolt 47. A hood, not shown, can be attached to the top wall 37 of component 21 in FIG. 5 in some cases.

A generally conventional awning support system including the hood 59 is provided in FIG. 6 by utilizing the two bracket components 20 and 22 together with a pair of wall anchor bolts 51, as described.

The awning support system is installed on the soffit 62, FIG. 7, again utilizing the two bracket components 20 and 21, an inclined bolt 64 and an additional vertical anchor screw 66, as described. The inclined bolt 64 may be an inclined wood screw where the soffit involved has wooden frames. It is to be noted that a countersunk area is provided around aperture 42 facing the awning fabric roll 13 so that the head of the bolt or screw 64 does not interfere with the awning fabric roll.

The apertures 25 and **25*a* in the vertical wall of bracket component 20 enable the mounting of the support system on a vertical wall with horizontal anchor bolts 51, FIG. 6, or by means of the suspension bolt 47, FIG. 5, without wall anchor bolts. However, for added security, wall anchor bolts or screws can be installed through the lower aperture 25 and the aperture 25*a* of the bracket component 20, FIG. 5**, in some cases.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A support system for a lateral arm awning having an elongated horizontal main support tube, said support system comprising first and second interengaged separable extruded mounting bracket components, the first mounting bracket component comprising a vertical wall having a connector head at its upper end and a pair of vertically spaced horizontal plate extensions on the vertical wall near the lower end of the first mounting bracket component, said plate extensions receiving said main support tube between them, said second mounting bracket component comprising a forwardly concave arcuate wall disposed immediately forwardly of said vertical wall and having a lower end pad engaging a top surface portion of the uppermost one of said plate extensions, said pad having a vertical threaded opening formed therethrough, said plate extensions being apertured and the apertures receiving a vertical screw immediately forwardly of the main support tube and having threaded engagement in said threaded aperture of said pad, a downwardly open yoke carried by said second mounting bracket component at its top and rear side and substantially at the top of said arcuate wall, said yoke having a connector passage receiving and having interlocking engagement with the connector head of the first mounting bracket component, a substantially horizontal top wall on the second mounting bracket component projecting forwardly of said arcuate wall and main support tube, and an inclined axis suspension bolt for the support system received through an inclined axis aperture of the second mounting bracket component near the top of said arcuate wall and forwardly of said yoke.

2. A support system for a lateral arm awning as defined in claim 1, and said vertical wall of the first mounting bracket component having a plurality of spaced apertures formed therethrough including one aperture between said plate extensions.

3. A support system for a lateral arm awning as defined in claim 1, and said plate extensions having locator shoulders for said main support tube formed thereon transversely, the main support tube being rectangular in cross section.

4. A support system for a lateral arm awning as defined in claim 1, and said connector head and connector passage each being of T-cross sectional shape.

5. A support system for a lateral arm awning as defined in claim 1, and said substantially horizontal top wall on the second mounting bracket component being slotted at its forward end.

6. A support system for a lateral arm awning as defined in claim 1, and the uppermost one of said plate extensions being provided on its upper side with spaced locator projections for said pad on opposite sides of said vertical screw.

7. A support system for a lateral arm awning as defined in claim 1, and said second mounting bracket component having a V-notch in its top between said top wall and yoke and said inclined axis aperture being formed through and perpendicular to one surface of the V-votch.

8. In a support system for lateral arm awnings and the like, a mounting bracket assembly adapted for attachment selectively to a vertical support surface or to a horizontal support surface, said bracket assembly comprising first and second interconnected separable bracket components, the first bracket component comprising an elongated flat wall which is vertically disposed during use, a connector head carried by the top of the elongated flat wall, and two vertically spaced horizontal apertured plate extensions carried by the elongated flat wall near its lower end and extending forwardly thereof during use, said horizontal plate extensions being adapted to straddle a main support tube of a lateral awning, said second bracket component comprising a forwardly concave arcuate wall above said plate extensions and forwardly of said elongated flat wall of the first bracket component, a top flat wall which is horizontal during use and extending forwardly of said arcuate wall and plate extensions and having a forward end opening, a downwardly open yoke portion on the second bracket component defining an upper rear corner thereon and being flush with the top face of said top flat wall and also being flush with the rear face of said elongated flat wall of the first bracket component, said yoke portion having a transverse horizontal connector passage formed therethrough of a cross-sectional shape matching the shape of said connector head of the first bracket component and receiving the connector head, and the second bracket component having a rearwardly and upwardly inclined fastener receiving opening formed therethrough forwardly of the yoke portion and substantially at the juncture of the curved wall portion, top flat wall, and said yoke portion, the arcuate wall portion having a vertical threaded aperture formed therethrough near its lower end in coaxial alignment with the apertures of the plate extensions of the first bracket component, whereby a threaded fastener can be placed through the apertures of the plate extensions and engaged within said threaded aperture.

9. In a support system for lateral arm awnings as defined in claim 8, and said elongated flat wall of the first bracket component being provided with spaced fastener receiving openings one of which is between said plate extensions.

10. In a support system for lateral arm awnings as defined in claim 8, and said arcuate wall of the second bracket component having a rear flat vertical surface abutting a forward flat surface of the elongated flat wall of said first bracket component.

11. In a support system for lateral arm awnings as defined in claim 10, and said connector head and connector passage being T-shaped in cross section.

* * * * *